US008393981B2

(12) United States Patent
Chandless

(10) Patent No.: US 8,393,981 B2
(45) Date of Patent: Mar. 12, 2013

(54) BALL TRAVEL-MODIFYING DEVICE

(76) Inventor: Steven Glen Chandless, San Mateo, CA (US)

( * ) Notice: Subject to any disclaimer, the term of this patent is extended or adjusted under 35 U.S.C. 154(b) by 551 days.

(21) Appl. No.: 11/731,151

(22) Filed: Mar. 29, 2007

(65) Prior Publication Data

US 2008/0242451 A1 Oct. 2, 2008

(51) Int. Cl.
*A63B 67/16* (2006.01)

(52) U.S. Cl. ..... 473/427

(58) Field of Classification Search ..... 473/423, 473/425–427, 430; 114/102.1; 116/174; 244/142; 124/4–5
See application file for complete search history.

(56) References Cited

U.S. PATENT DOCUMENTS

| | | | | |
|---|---|---|---|---|
| 2,942,883 | A * | 6/1960 | Moore | 473/424 |
| 3,042,401 | A | 7/1962 | Denegre | |
| 3,147,979 | A | 9/1964 | Wolfe | |
| 3,281,099 | A | 10/1966 | Conway | |
| 4,938,484 | A * | 7/1990 | Davis, Jr. | 473/511 |
| 5,250,016 | A | 10/1993 | Higgins | |
| 6,086,488 | A * | 7/2000 | Sanders | 473/423 |
| D506,233 | S | 6/2005 | Cruz | |
| 6,974,388 | B1 | 12/2005 | Williams, Jr. | |
| 6,976,926 | B2 * | 12/2005 | LaPointe | 473/429 |
| 7,115,052 | B2 | 10/2006 | Wardle et al. | |
| 2006/0223657 | A1 * | 10/2006 | Flanigan | 473/423 |

FOREIGN PATENT DOCUMENTS

| | | |
|---|---|---|
| GB | 2042 904 A | 10/1980 |
| GB | 2093 706 A | 9/1982 |
| WO | WO 91/06346 | 5/1991 |
| WO | WO 96/04964 | 2/1996 |
| WO | WO 03/041814 A1 | 5/2003 |

* cited by examiner

*Primary Examiner* — Gene Kim
*Assistant Examiner* — Amir Klayman
(74) *Attorney, Agent, or Firm* — GSS Law Group

(57) ABSTRACT

A ball travel-modifying device comprising a sail and a strikeable object modifies a travel distance and a rate of travel of a struck or thrown object and returns the strikeable object to an initial rest position after each hit or throw. Devices built in accordance with the invention are particularly suited for use with strikeable objects which are various kinds of balls. A separation distance between the strikeable object and the sail is adjustable. A separation distance between the strikeable object and a surface upon which a player stands may also be adjustable. In some embodiments, the strikeable object may be replaced with a strikeable object having a different size or weight. The shape of the sail is triangular, quadrilateral, or other shapes and may be symmetric or asymmetric. The sail may alternatively be formed with a flat or curved surface and straight or curved edges. One or more apertures may be formed in the sail to modify a speed or a direction of a moving strikeable object. Some embodiments have at least one adjustable aperture to permit adaptation to various strikeable objects having a variety of sizes and weights or to cause a strikeable object to move in a preferred direction or with a preferred rate of travel.

24 Claims, 8 Drawing Sheets

BALL TRAVEL-MODIFYING DEVICE

FIELD OF THE INVENTION

The present invention relates to a device to modify the travel of a strikeable object after the object has been struck or thrown.

BACKGROUND

In sports such as baseball, tennis, squash, golf, badminton, hockey, and soccer, a player hits, kicks, or throws a strikeable object over a relatively long distance at relatively high speed. A strikeable object may be, but is not limited to, a ball, a shuttlecock, or a puck. The word "ball" will be used herein as an example of any such strikeable object. Many players of such sports practice to improve their strength and skill in controlling the speed and direction of the strikeable object. However, limitations in a practice area, such as limited space, safety hazards, or obstacles that would interfere with or be damaged by a moving strikeable object, may make it impractical to allow an object to travel freely after being struck or thrown. Furthermore, it is sometimes desirable to present a strikeable object to a player in a manner convenient for repetitive practice, exercise, or physical therapy. Also, some players practice alone for enjoyment, to warm up before a game, or when other players are not available.

Some devices use a net or cage to capture a struck or thrown object. Some devices have a strikeable object with a plurality of holes wherein air flowing through the holes reduces the speed and the distance traveled by the object. Other devices attach a parachute to a strikeable object to achieve similar results. In some devices, the speed of the strikeable object is reduced but the direction of travel is not modified, so the object may land in a location from which it can not be easily or safely retrieved or the object may cause damage upon impacting another object. Other devices attach an elastic tether to a strikeable object to cause a struck or thrown object to return to the player. Some devices return the strikeable object to the player at a relatively high speed, which can be intimidating or unsafe for novice or young players. Some devices have limited portability or are difficult for young or inexperienced players to set up, and some devices are not suitable for indoor use.

SUMMARY

The present invention relates to a device to modify the travel of a strikeable object after the object has been struck or thrown. The invention includes a device comprising a strikeable object coupled to a sail. In some embodiments, the strikeable object is a ball. The sail is formed with three or more sides and has a shape and size to provide an effective amount of aerodynamic resistance to reduce the speed of a strikeable object placed in motion by a player. In some embodiments, the sail has a relatively large, flat surface. In other embodiments, the sail has a curved surface. The sail area may be symmetric or asymmetric relative to a reference line through the device. A strikeable object having at least one throughhole is adjustably coupled to the sail by a line passing slidably through the strikeable object and through a sleeve on the sail. Alternatively, the line is attached to the sail. In some embodiments, the strikeable object is detachable from the sail, enabling changes in the type of strikeable object used or replacement of a worn strikeable object.

A line connected to an end of a device built in accord with the invention permits attachment of the device to an external anchor. In some embodiments, the line is a suspension line that adjustably couples the strikeable object to the sail and adjustably couples the sail to the external anchor. In other embodiments, a first line is the suspension line and a second line is an adjustment line that adjustably couples the ball to the sail. The suspension line and adjustment line may be permanently attached to the sail or alternatively may be removably attached to the sail.

An external anchor may be a bracket, hook, clip, shackle, or similar connection hardware coupled to a wall, pole, support stand, beam, ceiling, fence, or similar stable structure, a hole formed in such a structure, or connection hardware coupled to a surface upon which the player stands, such as a stake driven into the ground or a shackle connected to a playing surface or to a heavy base such as a concrete block or heavy metal plate. Preferred external anchors will be displaced by a relatively small amount by a force from placing the strikeable object in motion or by a force from the object reaching a limit of its travel. An adjustable separation distance between the sail and the external anchor is set to a distance selected by the player. In some embodiments, the player may set an adjustable separation distance between the strikeable object and the sail or between the strikeable object and a surface upon which the player stands.

A spreader holds the sail open. In one embodiment, the spreader comprises a sleeve attached to the sail and a relatively stiff spreader bar positioned within the sleeve. Alternatively, the spreader bar is attached to the sail, to the suspension line, or both. In another embodiment, the spreader comprises flexible material, for example sail material, rolled into a cylindrical spiral attached to the sail.

The sail is suspended at one end from an external anchor. The strikeable object is suspended from an opposite end of the sail. A distance measured from the external anchor to the strikeable object, plus an additional distance from material stretching, corresponds to a limit of travel for the strikeable object after the player sets the strikeable object in motion. After reaching the limit of travel, the strikeable object returns to the rest position and may be struck or thrown again.

A maximum speed of the strikeable object is reached shortly after the strikeable object is placed in motion and leaves the rest position. Thereafter, the speed of the moving strikeable object is reduced by aerodynamic resistance acting against a large surface of the sail, with lesser contributions to aerodynamic resistance from other parts of the embodiments of the invention. The sail is effective in reducing the speed of the strikeable object while the strikeable object and sail are moving together through the air. In some embodiments, the sail is formed with an aperture to alter the aerodynamic resistance of the sail. A size, shape, position, and number of apertures are selected to give an effective amount of aerodynamic resistance for a combination of size and weight of strikeable object. Alternatively, the sail has an aperture with an adjustable closure to permit a player to adapt the aerodynamic resistance of the sail to strikeable objects having a variety of sizes and weights. In some embodiments, an asymmetric sail affects the path of a moving strikeable object.

This section summarizes some features of the present embodiment. These and other features, aspects, and advantages of the embodiments of the invention will become better understood with regard to the following description and upon reference to the following drawings, wherein:

DESCRIPTION

Embodiments of the invention include a device intended to modify the travel of a strikeable object after the strikeable object has been struck or thrown. Devices built in accord with the invention are particularly suited for use with various kinds of balls, and the example embodiments below will be described using a ball as the strikeable object. Some of the benefits of the embodiments of the invention include, but are not limited to, portability, safety, ease of set-up by young or inexperienced players, return of the ball to its initial rest position after being struck or thrown, suitability for use indoors or outdoors, suitability for unsupervised individual practice, adjustable separation of the sail and the external anchor, adjustable separation of the ball relative to the sail or relative to a surface upon which a player stands to accommodate players of different sizes or different preferred practice motions, and detachable coupling of the ball to the sail to enable use of different types of balls or replacement of a worn ball. Other benefits include use as an aid to improve a player's strength and coordination, development of muscle memory, and use as a physical therapy device.

Figure 1:
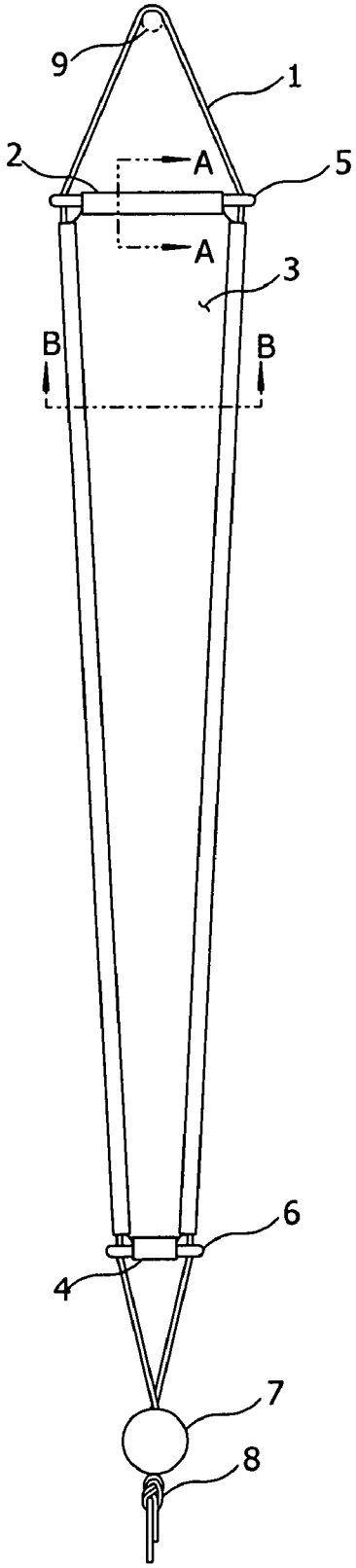
FIG. 1 is a front view of an embodiment of the invention.
Figure 2:
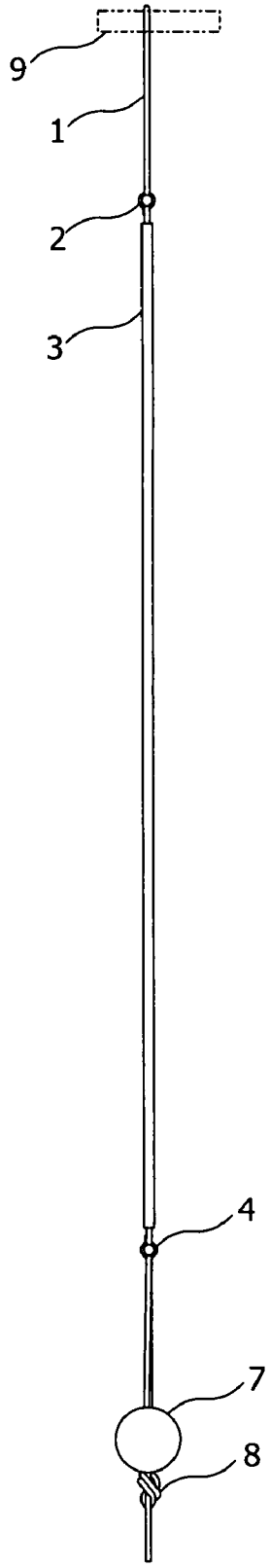
FIG. 2 is a side view of the embodiment of FIG. 1.
Figure 12:
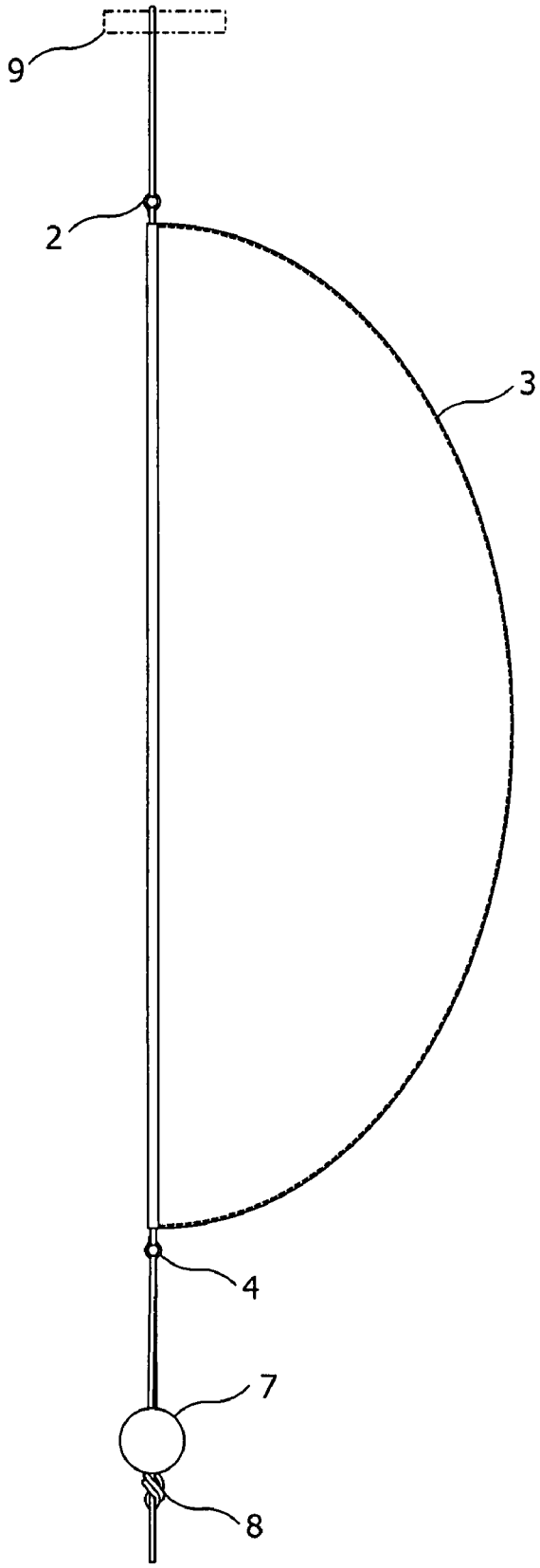
FIG. 12 is a side view of an embodiment having a sail with a curved surface.

An embodiment of the invention illustrated in FIG. 1 and FIG. 2 comprises a ball 7 coupled to a sail 3 with a suspension line 1. Aerodynamic resistance from the motion of the sail 3 through air reduces the speed of the ball 7 coupled to the sail 3. Other parts of the embodiments of the invention may also contribute to aerodynamic resistance. As shown in the side view of FIG. 2, the sail 3 is flat. Alternatively, the sail 3 may be shaped into a surface having a smooth curve or a surface with folds or wrinkles to provide differing amounts of aerodynamic resistance compared to a flat sail. A side view of an embodiment having a curved sail 3 appears in FIG. 12. The sail 3 in FIG. 12 is shown in a distended position. Curved shapes other than the one shown in FIG. 12 may be used.

Figure 13:
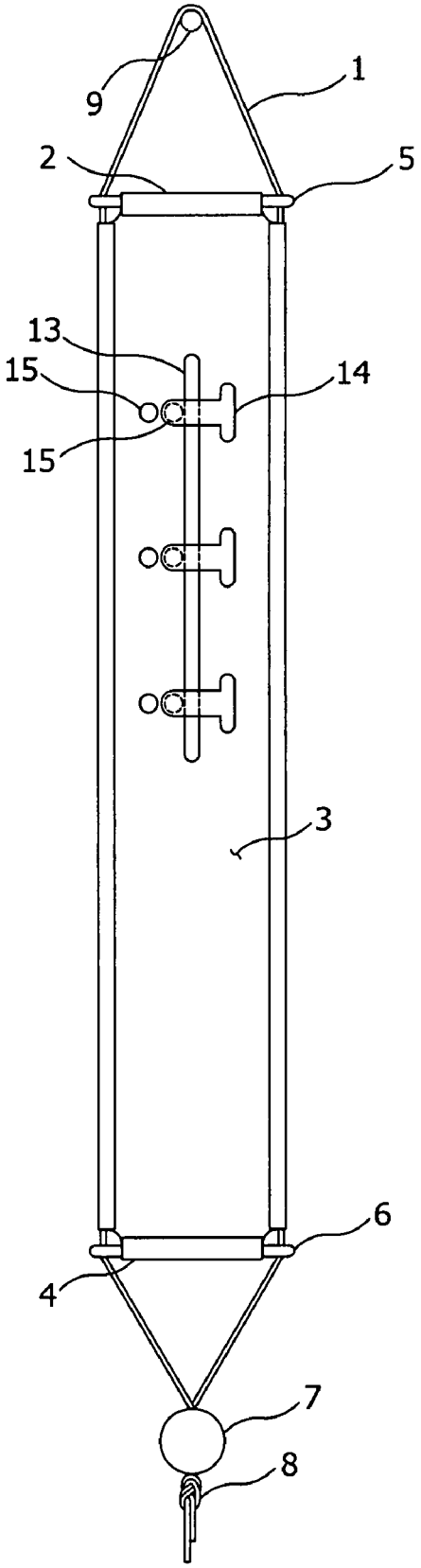
FIG. 13 is a front view of an embodiment having a rectangular sail, an aperture through the sail, an adjustable closure, and a closure fastener.
Figure 14:
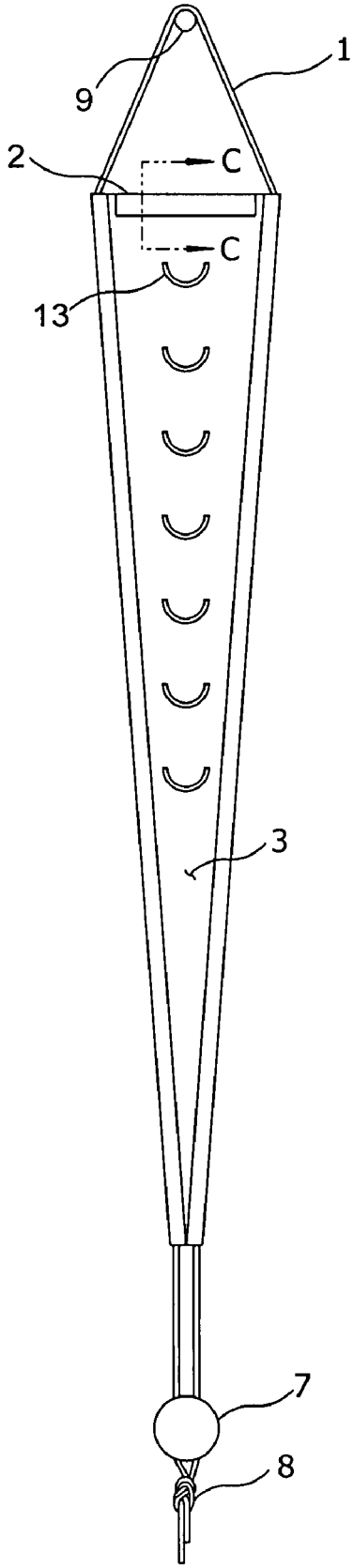
FIG. 14 is a front view of an embodiment having a triangular sail, a plurality of apertures through the sail, and a spreader made from a cylindrical spiral of flexible material.
Figure 15:
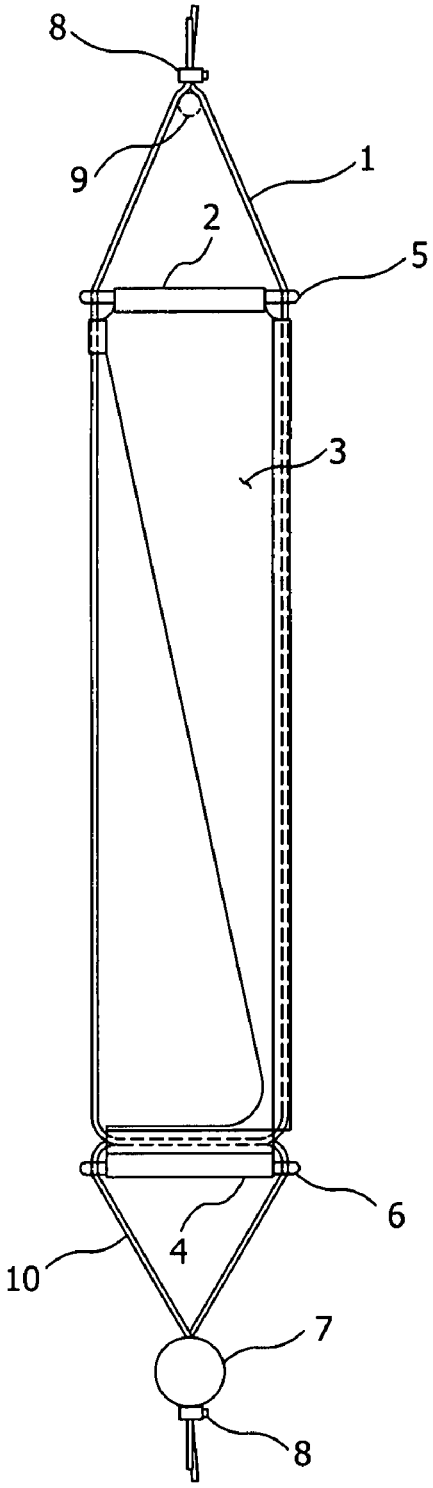
FIG. 15 is a front view of an embodiment having an asymmetric sail, a suspension line, and an adjustment line.

Alternative sail shapes include, but are not limited to, triangular, rectangular, or cross shape. The sail may be formed with more sail area on one side of a central axis of the embodiment than the other side of the central axis and is referred to herein as an asymmetric sail. In some embodiments an asymmetric sail causes a moving ball to travel on a preferred path. In the embodiment shown in FIG. 1, the sail 3 is quadrilateral. FIG. 13 shows a sail having a rectangular shape. A sail having a triangular shape is shown in FIG. 14. An asymmetric sail is shown in FIG. 15. The sail 3 may alternatively be formed with a straight edge or a curved edge. In an example of an embodiment having a ball 7 the size and weight of a baseball, the sail of FIG. 1 has a width of approximately 8 inches (20 cm) near the upper spreader 2, a width of approximately 4 inches (10 cm) near the lower spreader 4, and a length of approximately 50 to 60 inches (127 to 152 cm), but other dimensions may also be used.

The material of the sail 3 is chosen for strength, flexibility, resistance to damage from abrasion, sunlight, and moisture, light weight, and ease of forming into a desired shape. Examples of sail materials include, but are not limited to, woven fabric made from cotton, nylon, or polyester, blends that include these materials, fabrics made from these materials having an open weave to permit air to flow through holes in the weave, and nonwoven materials such as polyester formed into thin, strong, flexible sheets. The sail may alternatively be formed from a stiff or flexible material.

Figure 9:
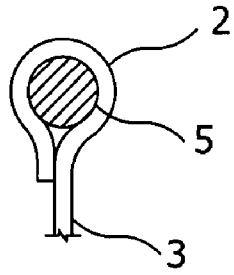
FIG. 9 is an enlarged section of a spreader having a spreader bar in a sleeve formed in the sail. The viewing direction for FIG. 9 is shown by a line A-A in FIG. 1.

In the embodiment of FIG. 1, the sail 3 is held open by an upper spreader 2 near the top end of the sail and a lower spreader 4 near the bottom end of the sail. The upper spreader 2 comprises a relatively stiff upper spreader bar 5 inside a sleeve on the sail 3. The lower spreader 4 comprises a relatively stiff lower spreader bar 6 inside a sleeve on the sail 3. Alternatively, a spreader may be located at a preferred separation distance from an edge of the sail 3. A sleeve may be formed by folding a tab of material extending from an edge of the sail back onto a surface of the sail and attaching the tab to the sail by sewing, adhesive, rivets, fusing, or an equivalent attachment method. Or, a sleeve may be made separately from the sail and attached to a surface of the sail. An enlarged cross section of the upper spreader 2 as viewed along the line A-A in FIG. 1 is shown in FIG. 9. Alternatively, a spreader bar may be attached to a surface or an edge of the sail without a sleeve.

Figure 19:
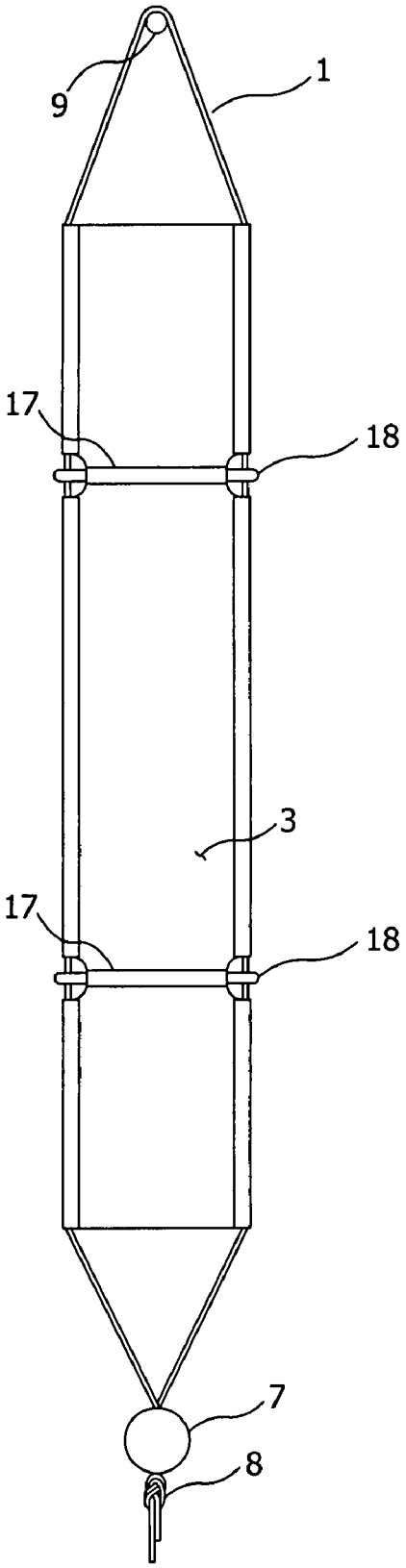
FIG. 19 is a front view of an embodiment having a spreader connected to the sail a preferred distance from an edge of the sail.
Figure 20:
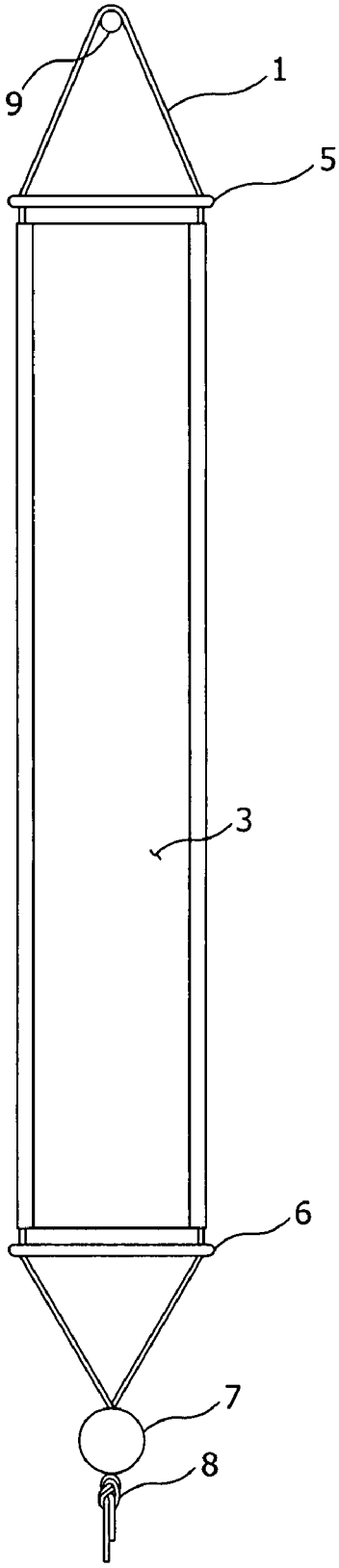
FIG. 20 is a front view of an embodiment having a spreader separated from the sail by a preferred distance.

A spreader may alternatively be located a preferred distance from an edge of the sail, as shown in FIG. 19. In FIG. 19, a first spreader 17 comprising a spreader bar 18 is separated from the top end of the sail 3 and a second spreader 17 comprising a spreader bar 18 is separated from the bottom end of the sail 3. In other embodiments, a different number of spreaders and spreader locations may be used. One or all of the spreader 17 may be of the type illustrated in FIG. 19, which includes a spreader bar 18, or of the type shown in FIG. 10, in which a roll of flexible material is formed into a spreader and a spreader bar is not included, and any of these spreaders may be combined with spreaders located at an end of the sail. The spreaders may optionally have the same or different lengths, and the spreader bar 18 may optionally be coupled to the suspension line 1, to the sail 3, or to both. In another embodiment, an upper spreader bar 5 and, optionally, a lower spreader bar 6 are coupled to the suspension line 1, but not to the sail 3. An embodiment having a spreader bar separated from the sail is shown in FIG. 20.

In embodiments of the invention wherein a portion of the sail 3 is free to slide along the suspension line 1 and wherein the material of the sail is sufficiently flexible, a length of the sail 3 may be adjusted by sliding an end of the sail toward the opposite end. The resulting shortened and folded or wrinkled sail will have a different amount of aerodynamic resistance compared to a sail stretched to its full length. Such a change in the length of the sail 3 may be made to affect a rate or direction of travel by a struck or thrown ball 7 or other strikeable object coupled to the embodiment.

In some embodiments, a spreader bar holds a side of the sail apart from another side of the sail by a preferred amount. A spreader bar may optionally be formed with an aperture through which a line passes. The aperture may optionally be sized for a clearance fit of the line or a compression fit of the line. A spreader bar having an aperture sized for a compression fit of a line may be adjustably positioned along the line and will be held in place after adjustment by compression of the line. The aperture may optionally be a through-hole separated by a preferred distance from an end of the spreader bar, or a slot extending from an end of the spreader bar toward a center point along a long dimension of the spreader bar. The walls of the slot may optionally be non-parallel to enhance compression of the line.

Figure 3:
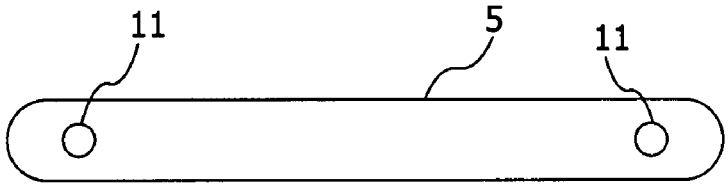
FIG. 3 is a top view of an example of a spreader bar.
Figure 4:
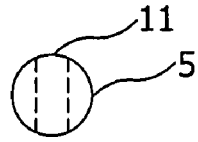
FIG. 4 is an end view of the spreader bar of FIG. 3.

A top view of an example of an upper spreader bar 5 is shown in FIG. 3. An end view of the upper spreader bar 5 of FIG. 3 is shown in FIG. 4. A through-hole 11 formed near an end of the upper spreader bar 5 is sized to allow a clearance fit of the suspension line 1. Another through-hole 11 is formed near an opposite end of the upper spreader bar 5. In some embodiments, the material of the upper spreader bar 5 is wood. Alternative materials for the upper spreader bar 5 include, but are not limited to, metal, plastic, glass- or carbon-fiber reinforced plastic or other materials possessing flexibility, strength, and light weight. The cross-sectional shape of the upper spreader bar 5 and lower spreader bar 6 may be round, square, rectangular, or any other shape giving a spreader bar having a preferred amount of stiffness.

Figure 10:
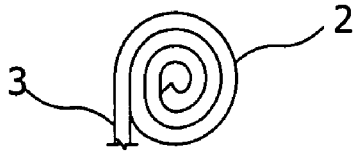
FIG. 10 is an enlarged section of a spreader made from a cylindrical spiral of sail material. The viewing direction for FIG. 10 is shown by a line C-C in FIG. 14.

In an alternative embodiment shown in FIG. 14, the upper spreader 2 comprises flexible material, for example sail material, rolled into a cylindrical spiral. The cylindrical spiral may be formed from material extending from an edge of the sail 3 or alternatively from a separate piece of material. The cylindrical spiral is prevented from unrolling by sewing, riveting, or bonding with adhesive. An illustration of an example of an upper spreader formed from a roll of sail material is shown in the enlarged cross section of FIG. 10. The viewing direction for FIG. 10 is shown by a line marked C-C in FIG. 14.

In embodiments such as the one shown in FIG. 1, the upper spreader 2 has a different length than the lower spreader 4. In embodiments such as the one shown in FIG. 13, the upper spreader 2 and the lower spreader 4 are the same length. A spreader may extend farther from one side of a long axis of an embodiment of the invention than another side of the long axis to support an asymmetric sail. One or both of the spreaders may alternatively be of the type shown in FIG. 9 or FIG. 10. Alternatively, the sail has only one spreader 2, as shown in FIG. 14, has a spreader formed into a "C" or "U" shape that combines the upper spreader 2 and lower spreader 4 into a single piece, or has spreaders in sleeves on one or both sides of the sail 3.

Figure 5:
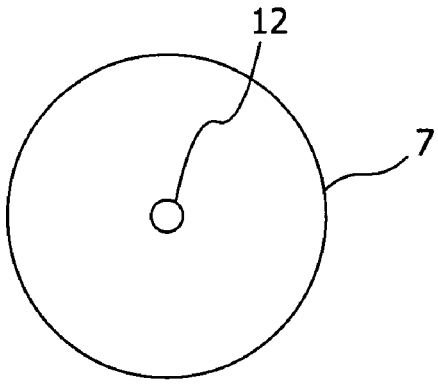
FIG. 5 is a top view of an example of a ball having a through-hole.
Figure 6:
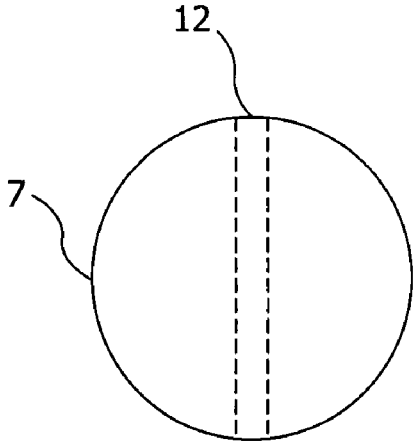
FIG. 6 is a front view of the ball of FIG. 5.
Figure 7:
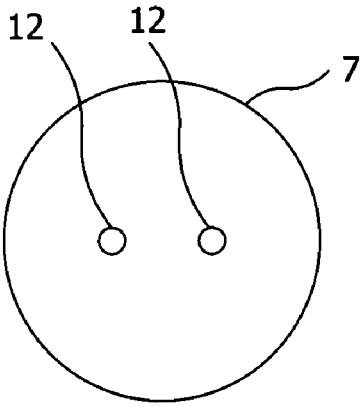
FIG. 7 is a top view of an example of a ball having two through-holes.
Figure 8:
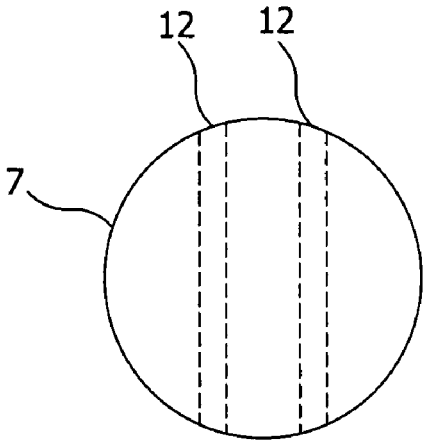
FIG. 8 is a front view of the ball of FIG. 7.
Figure 17:
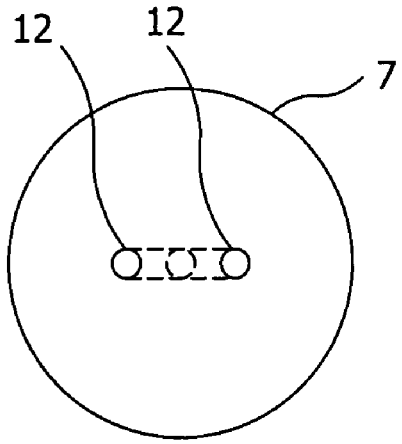
FIG. 17 is a top view of an example of a ball having two intersecting through-holes.
Figure 18:
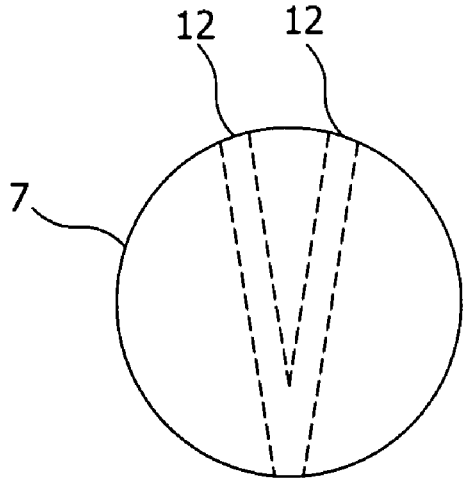
FIG. 18 is a front view of the ball of FIG. 17.

The embodiment of FIG. 1 includes the ball 7. A top view of the ball 7 is shown in FIG. 5 and a front view is shown in FIG. 6. The ball 7 is provided with a through-hole 12 having a diameter sufficiently large to admit two strands of line. Another embodiment of the ball 7 with two through-holes is shown in FIG. 7 in a top view and FIG. 8 in a front view, with each through-hole 12 sized to admit a single strand of line. A long axis of a through-hole 12 may alternatively be parallel to an axis through the center of the ball or not parallel to an axis through the center of the ball. FIG. 17 shows a top view of a ball having a first through-hole 12 which intersects a second through-hole 12. A front view of the ball of FIG. 17 is shown in FIG. 18.

In the embodiment shown in FIG. 1, FIG. 3, and FIG. 5, the sail 3, upper spreader 2, lower spreader 4, and ball 7 are coupled together by a suspension line 1. An end of the suspension line 1 is passed through a hole 12 in the ball 7, through a first hole 11 in an end of the lower spreader bar 6, through a sleeve along a first side of the sail 3, through a first hole 11 in an end of the upper spreader bar 5, through a second hole 11 in the upper spreader bar 5, through a sleeve along a second side of the sail 3, through a second hole 11 in the lower spreader bar 6, and back through the hole 12 in the ball 7. Alternatively, the upper spreader bar 5 and lower spreader bar 6 may be formed without the through-holes 11 shown in FIG. 3, and may therefore not be coupled to the suspension line 1. An embodiment having an upper spreader 2 that is not coupled to the suspension line 1 is shown in FIG. 14. Or, a spreader bar may be attached to the suspension line 1 but not attached to the sail 3, as shown in FIG. 20.

In other embodiments, a line for coupling the ball 7 to the sail 3 is an adjustment line 10, a separate line from the suspension line 1. An embodiment having an adjustment line 10 and a suspension line 1 is shown in FIG. 15. In some embodiments with an adjustment line 10, the adjustment line 10 or the ball 7, or both, are detachable. In embodiments with a suspension line 1 and an adjustment line 10, the two lines may pass through the same sleeve in the sail as shown in FIG. 15, or the suspension line 1 may pass through a sleeve at one end of the sail and the adjustment line 10 may pass through a sleeve at an opposite end of the sail.

Figure 11:
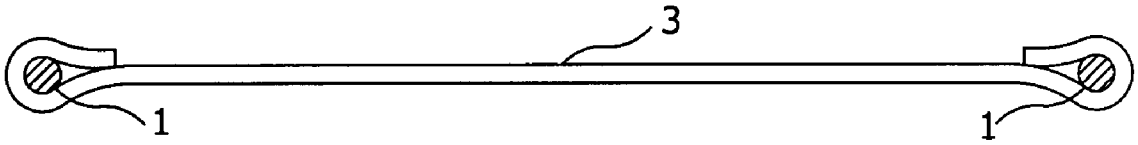
FIG. 11 is an enlarged section of the sail showing a suspension line in a sleeve on the sail. The viewing direction for FIG. 11 is shown by a line B-B in FIG. 1.

An enlarged cross section in FIG. 11 shows the suspension line 1 inside sleeves along the sides of the sail 3. The viewing direction for FIG. 11 is shown by a line B-B in FIG. 1. For embodiments having a suspension line 1 and an adjustment line 10 in separate sleeves, the sail 3 may be formed without sleeves along the sides, or the sleeves may contain a stiff rod, wire, or bar with or instead of a suspension line 1. A sufficient amount of slack is provided in the suspension line 1 between the first and second holes in the upper spreader bar 5 to permit the embodiments of the invention to be suspended from an external anchor 9. The external anchor 9 is not a part of the embodiments described herein. The suspension line 1 remains attached to the external anchor 9 point while the embodiment is in use, but may be detached from the external anchor 9 to permit storage or use of an embodiment of the invention at another location.

As shown in FIG. 1, an adjustable line restraint 8 for setting an adjustable separation between the ball 7 and the lower end of the sail 3 comprises a knot formed in the suspension line 1 underneath and adjacent to the ball 7. In other embodiments, the adjustable line restraint 8 couples the ball 7 to the adjustment line 10, as shown in FIG. 15. The adjustable line restraint 8 may alternatively comprise a knot, clip, line toggle, cord lock, ferrule, or clamp. An embodiment having an adjustable line restraint 8 comprising a cord lock coupled to the suspension line 1 and another line restraint 8 comprising a cord lock coupled to the adjustment line 10 is shown in FIG. 15.

Figure 16:
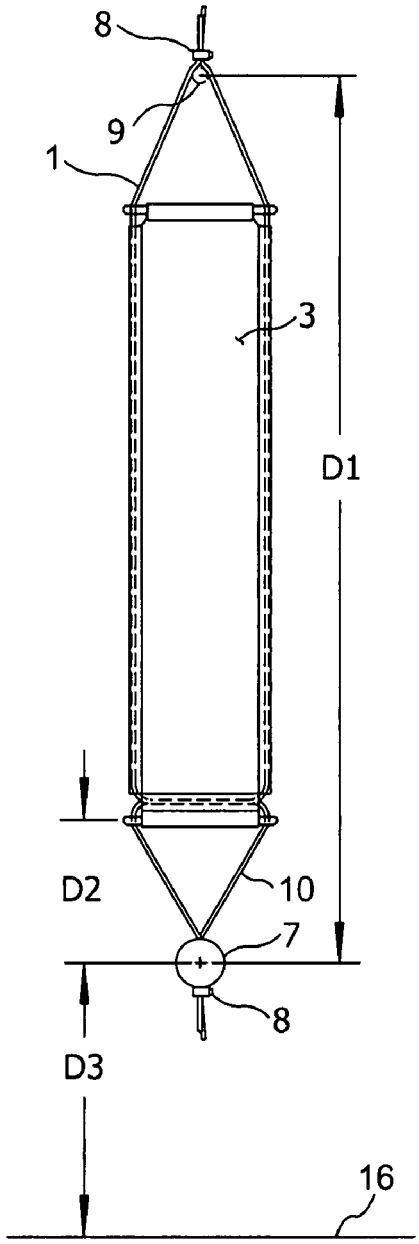
FIG. 16 is a front view of an embodiment having a suspension line and a adjustment line and showing adjustable separation distances D1, D2, and D3.

By positioning a first adjustable line restraint 8 on the suspension line 1 and a second adjustable line restraint 8 on the adjustment line 10, the position of the ball 7 may be adjusted to a preferred separation distance between the ball and the external anchor 9, as shown in FIG. 16 by the distance marked D1. A preferred separation distance between the ball 7 and the bottom end of the sail 3 may be set as shown by the distance marked D2 in FIG. 16. In an embodiment having a suspension line 1 but not an adjustment line 10, for example the embodiment of FIG. 1, separation distance D2 may not be set independently of separation distance D1. A preferred separation distance between the ball 7 and a surface upon which a person stands 16 may be set as shown by the distance marked D3 in FIG. 16. An example of a separation distance between the ball 7 and the lower end of the sail 3 is about two to three feet, but other separation distances may be used.

The material of the suspension line 1 and adjustment line 10 is chosen to be strong enough to withstand repeated impulse loads from striking or throwing the ball, have good abrasion resistance, and resist damage from sunlight and moisture. Examples materials include, but are not limited to, nylon, polyester, metal wire, blends of these materials with each other or with other materials, and lines formed from joined segments of these and other materials.

In some embodiments, the position of the upper spreader 2 on the suspension line 1 is adjustable. In other embodiments, the upper spreader 2 is prevented from slipping along the suspension line 1 by knots formed in the suspension line 1 underneath and adjacent to the upper spreader 2. In some embodiments, a ferrule attached to the suspension line 1 prevents the upper spreader 2 from slipping along the line. Alternatively, a ferrule is attached to the suspension line with a sliding fit and reduces wear on the suspension line 1. In other embodiments, the suspension line 1 is permanently attached by adhesive, fusing, or sewing to the sail 3, thereby preventing the sail 3 and upper spreader 2 from slipping along the line. A lower spreader 4 may optionally be adjustable or prevented from slipping along the suspension line 1 in a manner comparable to that of the upper spreader 2. In other embodiments, the lower spreader 4 is optionally adjustable or prevented from slipping along the adjustment line 10.

The aerodynamic resistance generated by the sail 3 may be modified by forming an aperture in a large surface of the sail. Examples of embodiments having a sail 3 with an aperture 13 are shown in FIG. 13 and FIG. 14. In FIG. 13, an aperture 13 has the shape of a long slot. In FIG. 14, a plurality of apertures 13 each have the shape of a semicircular arc. Alternatively, a plurality of apertures having other shapes and sizes are formed in the sail 3. A size, shape, and number of apertures are selected to provide a preferred amount of aerodynamic resistance for a preferred size and weight of ball.

In the embodiment of FIG. 13, the aerodynamic resistance of the sail 3 is adjustable to accommodate a variety of balls having different sizes and weights. In FIG. 13, the aperture 13 is opened or closed by at least one adjustable closure 14. The adjustable closure 14 is attached to a surface of the sail and connects from a side of the aperture 13 to one or more closure fasteners 15 on an opposite side of the aperture 13, thereby permitting the aperture 13 to optionally be open, partially closed, or closed. Examples of closure fasteners 15 include, but are not limited to, snaps, ties, buttons, zippers, and hook-and-loop fasteners.

The present disclosure is to be taken as illustrative rather than as limiting the scope, nature, or spirit of the subject matter claimed below. Numerous modifications and variations will become apparent to those skilled in the art after studying the disclosure, including use of equivalent functional and/or structural substitutes for elements described herein, use of equivalent functional couplings for couplings described herein, or use of equivalent functional steps for steps described herein. Such insubstantial variations are to be considered within the scope of what is contemplated here. Moreover, if plural examples are given for specific means, or steps, and extrapolation between or beyond such given examples is obvious in view of the present disclosure, then the disclosure is to be deemed as effectively disclosing and thus covering at least such extrapolations.

Unless expressly stated otherwise herein, ordinary terms have their corresponding ordinary meanings within the respective contexts of their presentations, and ordinary terms of art have their corresponding regular meanings.

What is claimed is:

1. A device for modifying the travel of a strikeable object, comprising:

a suspension line configured for attaching said device to an external anchor;

a sail configured for producing aerodynamic resistance, said sail having a first end, a second end, a first side and a second side, said first end of said sail being connected to said suspension line;

a spreader, said spreader configured for maintaining a preferred distance between said first side of said sail and said second side of said sail;

an adjustable aperture passing through said sail from a front surface of said sail to a back surface of said sail, said adjustable aperture configured to be selectively opened to decrease said aerodynamic resistance produced by said sail and selectively closed to increase said aerodynamic resistance produced by said sail; and a strikeable object coupled to said second end of said sail;

wherein, when said strikeable object is in a rest position, said device is vertically suspended from the external anchor by said suspension line, with said strikeable object suspended below said sail;

wherein, when said strikeable object is set in motion, aerodynamic resistance produced by said sail reduces the speed and distance traveled by said strikeable object;

and wherein, when said strikeable object reaches a limit of travel, said strikeable object returns to said rest position due to a weight of said strikeable object, and aerodynamic resistance produced by said sail reduces the speed of the return of said strikeable object to said rest position.

2. The device of claim 1, wherein said strikeable object is detachably coupled to said sail.

3. The device of claim 2, further comprising a first separation distance between said second end of said sail and said strikeable object, wherein said first separation distance is adjustable.

4. The device of claim 3, further comprising a second separation distance between said strikeable object and a surface upon which a person stands, wherein said second separation distance is adjustable.

5. The device of claim 3, further comprising an adjustable line restraint, wherein a position of said adjustable line restraint corresponds to said first separation distance between said second end of said sail and said strikeable object.

6. The device of claim 1, wherein said spreader is connected to said suspension line.

7. The device of claim 5, further comprising an adjustment line, wherein said adjustment line is detachably connected to said second end of said sail and said adjustment line is detachably connected to said strikeable object.

8. The device of claim 7, wherein said adjustable line restraint is coupled to said adjustment line.

9. The device of claim 1, wherein said sail further comprises:

a first sleeve formed in said sail on said first side; and a second sleeve formed in said sail on said second side, wherein said suspension line passes through said first and second sleeves.

10. The device of claim 9, wherein said spreader comprises flexible material formed into a cylindrical spiral, said cylindrical spiral comprising a plurality of spiral wraps of said flexible material.

11. The device of claim 9, wherein said spreader comprises:

a spreader bar retaining sleeve attached to said sail; and a spreader bar inserted into said spreader bar retaining sleeve.

12. The device of claim 1, wherein said sail has an asymmetric shape with more sail area on one side of a central axis extending from said first end of said sail to said second end of said sail than on the other side of said central axis.

13. The device of claim 12, wherein said asymmetric shape causes said strikeable object to travel on a preferred path.

14. The device of claim 1, wherein said sail has a quadrilateral shape.

15. The device of claim 1, wherein said sail has a triangular shape.

16. The device of claim 1, wherein the strikeable object may be detached and replaced with a different strikeable object.

17. The device of claim 16, wherein the strikeable object is a ball.

18. The device of claim 1, further comprising a plurality of apertures passing through said sail from said front surface to said back surface.

19. The device of claim 1, further comprising:

a closure fastener configured for selectively closing said adjustable aperture to increase said aerodynamic resistance produced by said sail.

20. The device of claim 1, further comprising:

a plurality of closure fasteners configured for selectively closing said adjustable aperture to increase said aerodynamic resistance produced by said sail.

21. The device of claim 1, wherein said strikeable object comprises a shuttlecock.

22. The device of claim 1, wherein said strikeable object comprises a puck.

23. The device of claim 1, wherein said front surface and said back surface of said sail have a non-planar curvature.

24. The device of claim 1, wherein said sail further comprises:

a first sleeve formed in said sail along said first side;

a second sleeve formed in said sail along said second side, wherein said suspension line passes through said first and second sleeves;

and wherein said spreader comprises:

a spreader bar retaining sleeve attached to said sail; and a spreader bar inserted into said spreader bar retaining sleeve.

* * * * *